US007338309B2

(12) United States Patent
Gremillion et al.

(10) Patent No.: US 7,338,309 B2
(45) Date of Patent: Mar. 4, 2008

(54) LOCKING OUTLET COVER AND METHOD OF USE

(76) Inventors: James G. Gremillion, 14359 S. Lakeshore Dr., Covington, LA (US) 70435; Beverly Gremillion, 14359 S. Lakeshore Dr., Covington, LA (US) 70435

( * ) Notice: Subject to any disclaimer, the term of this patent is extended or adjusted under 35 U.S.C. 154(b) by 36 days.

(21) Appl. No.: 11/258,709

(22) Filed: Oct. 26, 2005

(65) Prior Publication Data

US 2007/0093115 A1 Apr. 26, 2007

(51) Int. Cl.
*H01R 13/62* (2006.01)

(52) U.S. Cl. ..... 439/373

(58) Field of Classification Search ..... 439/373, 439/147, 135; 174/67, 66
See application file for complete search history.

(56) References Cited

U.S. PATENT DOCUMENTS 2,399,644 A * 5/1946 Lachance ..... 439/362
3,068,442 A * 12/1962 Kubik et al. ..... 439/136
4,840,577 A * 6/1989 Prouty ..... 439/373
4,895,527 A 1/1990 Brown et al.
4,950,842 A 8/1990 Menninga
5,288,945 A * 2/1994 Bruce ..... 174/67
5,391,837 A 2/1995 Carey
6,309,239 B1 * 10/2001 Johnston ..... 439/373
6,699,060 B1 * 3/2004 Scott ..... 439/373
6,805,580 B2 * 10/2004 Piedmont ..... 439/516

* cited by examiner

*Primary Examiner*—Gary F. Paumen
(74) *Attorney, Agent, or Firm*—Raymond M. Galasso; Galasso & Associates, LP

(57) ABSTRACT

The locking outlet cover is designed to protect electrical outlets from children. It includes an plate that attaches to a regular electrical receptacle. The plate then comprises a slide channel that is located above and below each outlet opening. On the slide channel is a round housing that is divided into two sliding cover halves. These two sliding cover halves extend outward from the outlet and slide along the slide channels to open and close. By moving the two sliding cover halves to an open position, an electrical plug can be inserted. Then the two sliding cover halves are moved to a closed position around the electrical cord. The two sliding cover halves have a threaded hole which allows the two sliding cover halves to be locked into place when in the closed position by inserting a screw into the threaded hole.

13 Claims, 3 Drawing Sheets

LOCKING OUTLET COVER AND METHOD OF USE

FIELD OF THE DISCLOSURE

An electrical outlet protective cover for protection of the outlet.

BACKGROUND

Electrical outlets have long been a danger than many parents with small children have faced. At some point in time, almost every child will become fascinated with the electrical outlets in the house. Whether they try to insert fingers or objects into the outlet it is all dangerous. Additionally, cords that are plugged into the outlet can become a danger to children. Again their fascination with the electrical plug and the process of inserting a cord into the outlet seems to attract their attention and yet they do not understand that other objects are not supposed to be inserted into the outlet. Nor do they understand the danger involved with an electrical outlet.

There are a number of options available on the market today that provide some form of protection. They are not always the easiest to use nor the best possible solution. Although, some solution is better than doing nothing. One example of a product already on the market is the plastic inserts that plug directly into the outlet. When you are ready to use the outlet you must remove the plastic plug and plug in your cord. These plastic plug covers are relatively inexpensive and easy to install. However, when you want to actually use the outlet, removing the plastic plug is not always that easy to do. Another draw back to this type of outlet protector is these plug protectors are easy to misplace when you remove them and insert your electrical cord.

One example of an electrical outlet protector is the one disclosed in U.S. Pat. No. 4,950,842 by Menninga. In this configuration, the electrical outlet protector involves a box like cover that replaces the typical face plate and a frame that fits around the wall outlet. The frame has an opening at the bottom that allows the cord to extend through the frame and plug into the outlet. Once the cords are plugged into the outlet, the cover is placed over the cords and the frame and is held in place by use of a spring system and ears located on the frame. While this serves to protect the outlet, it seems overly burdensome every time you need to plug or unplug a cord.

Another example of an electrical safety cover is disclosed in U.S. Pat. No. 4,895,527 by Brown et al. In the Brown et al. patent, a safety cover for a dual outlet receptacle is disclosed, wherein the safety cover comprises an inclined surface wherein maximum depth over one outlet is obtained and minimal depth over the second outlet. The outlet comprising the maximum depth allows the insertion of the plug in a rotated position and once it is inserted into the safety cover, is rotated back to the normal position for plugging into the outlet and prevents the retraction of the plug without rotation. The plug having minimal depth allows for the direct insertion of the plug. However, the safety cover could be configured to have maximum depth over each of the outlets. Unfortunately, because of the potential configuration of the outlet having minimal depth, it does not adequately protect a child from being able to insert objects into the outlet or potentially insert a finger into the outlet.

The configuration of Menninga and Brown et al. both provide a means for preventing the removal of the plug by accident. In order for the plug to be removed from the outlet, a deliberate action is required. Therefore, if you tripped over the cord, it would not pull lose from the outlet. Alternatively, you would not be able to overstretch the cord and pull it from the outlet by accident.

Obviously there are a number of alternatives available for protecting electrical outlets not only from intrusion by children but in helping to keep plugs from being pulled free of the electrical outlets.

SUMMARY OF THE DISCLOSURE

In one embodiment the locking outlet cover comprises a plate that attaches to a regular electrical receptacle.

In another embodiment the locking outlet cover includes a slide channel located above each outlet opening.

In still another embodiment the locking outlet cover includes a slide channel located below each outlet opening.

In yet another embodiment the locking outlet cover contains a round housing.

In another embodiment the round housing is divided into two sliding cover halves.

In still another embodiment the two sliding cover halves are operable to slide with the slide channels.

In yet another embodiment the two sliding cover halves extend outwardly.

In another embodiment the two sliding cover halves contain a threaded hole.

In still another embodiment the threaded hole functions to lock the two sliding cover halves together in a closed position.

In yet another embodiment the sliding cover halves extend outwardly approximately one inch.

In another embodiment the round housing is operable to close around an electrical card plugged into the receptacle.

In still another embodiment the round housing is capable of being locked into place when an electrical cord is plugged into the receptacle.

In yet another embodiment the round housing is comprised of thermoplastics.

In another embodiment the locking outlet cover is prevents the removal of an electrical cord when in the locked position.

Still other advantages of various embodiments will become apparent to those skilled in this art from the following description wherein there is shown and described preferred embodiments of this invention simply for the purposes of illustration. As will be realized, the invention is capable of other different aspects and embodiments without departing from the scope of the invention. Accordingly, the advantages, drawings, and descriptions are illustrative in nature and not restrictive in nature.

DETAILED DESCRIPTION OF THE DRAWING FIGURES

In the following detailed description of the preferred embodiments, reference is made to the accompanying drawings which form a part hereof, and in which is shown by way of illustration specific preferred embodiments in which the invention may be practiced. These embodiments are described in sufficient detail to enable those skilled in the art to practice the invention, and it is to be understood that other embodiments may be utilized and that logical, mechanical and electrical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
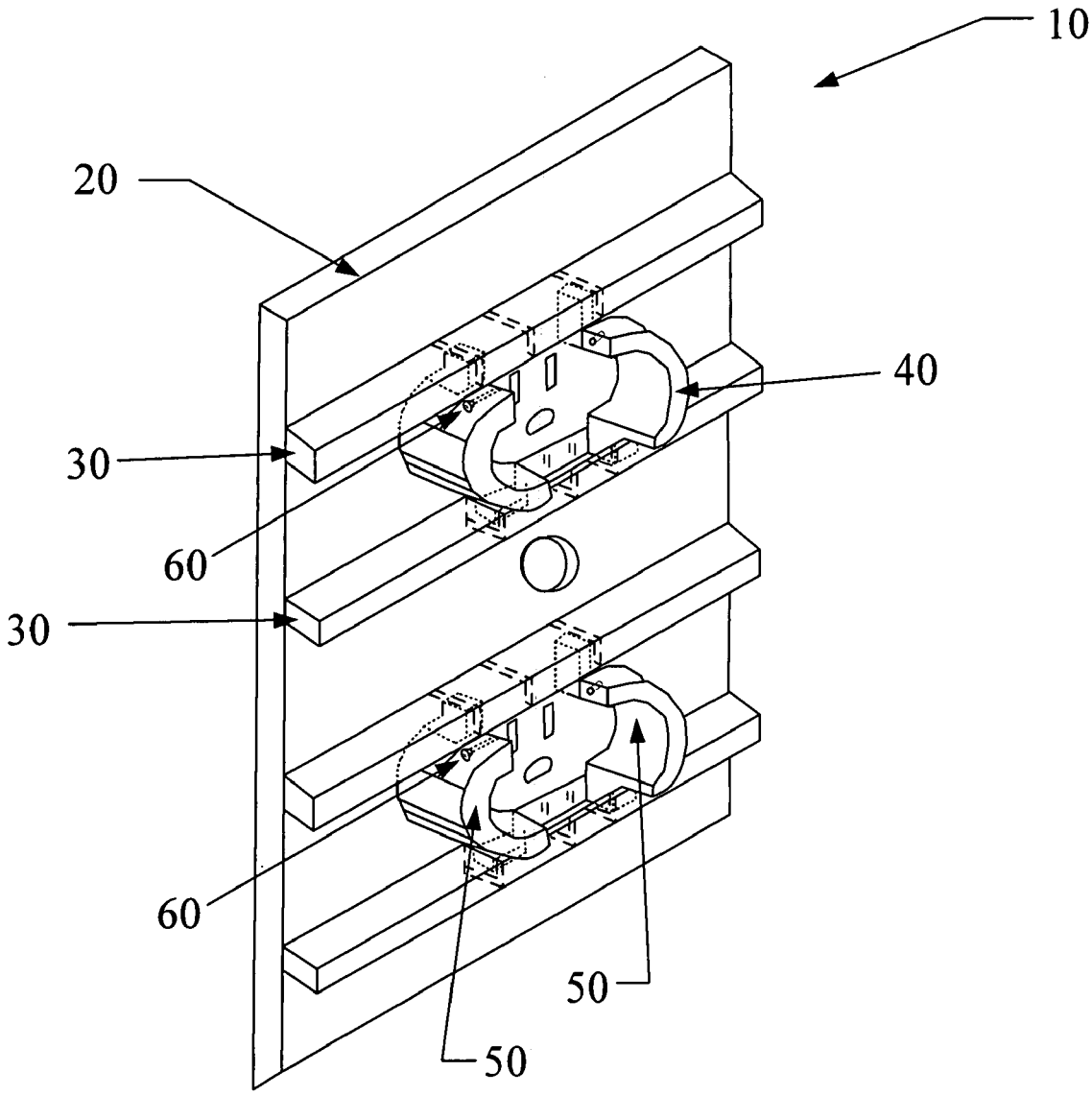
FIG. 1 is perspective view of an locking outlet cover.

FIG. 1 illustrates a locking outlet cover 10 comprising a plate 20, slide channels 30, a round housing 40, sliding cover halves 50 and threaded hole 60. The locking cover 10 is designed to protect children from playing with electrical outlets. The locking cover 10 includes a plate 20 that is placed over a regular electrical outlet in lieu of the current plate that is on the electrical outlet. Once the plate is placed over the electrical outlet, the round housing 40 which is divided into two sliding cover halves 50 can be opened by sliding the two sliding cover halves 50 along the slide channels 30 which are located above and below each outlet. When the two sliding cover halves 50 are in the open position, then an electrical plug can be inserted into the outlet. Once the plug is inserted into the outlet, the sliding cover halves 50 can be moved to the closed position by sliding the sliding cover halves 50 along the slide channels 30. If the user desires, the sliding cover halves 50 can be locked into the closed position by inserting a screw into the threaded hole 60. Because the sliding cover halves 50 can close with an electrical plug inserted into the outlet, the sliding cover halves 50 can be locked regardless of whether the outlet is being used or not. For example, if a user had a lamp that was plugged into an outlet comprising the locking outlet cover 10 and the other outlet was free for use, then the sliding cover halves 50 that are closed around the electrical plug could be locked into place and would most likely remain that way. While the other outlet could be locked into place until ready for use. Alternatively, if the user wants to use an outlet but chooses not to lock the sliding cover halves 50 together during use, then the sliding cover halves 50 can remain in the open position or they can be closed and not locked.

Figure 2:
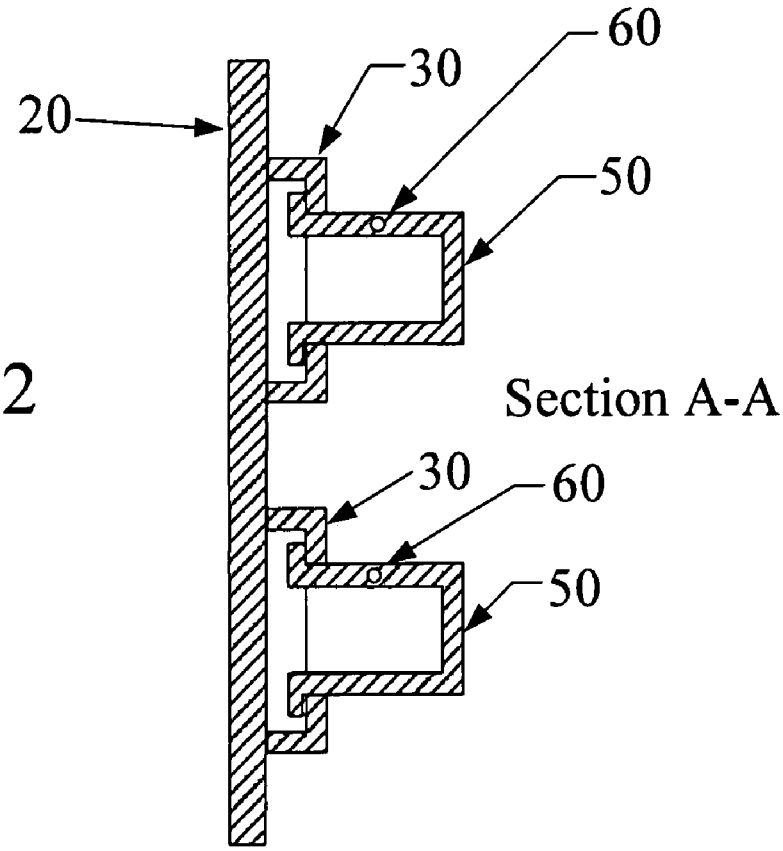
FIG. 2 is a cross-section view of the locking outlet cover depicted in FIG. 1.

FIG. 2 is a cross-sectional view of the locking outlet cover 10 depicted in FIG. 1. Specifically, FIG. 2 discloses the plate 20, the sliding channels 30, the round housing 40 and the threaded hole 80. As is clearly demonstrated in this FIG. 2, the round housing 40 which is comprised of two sliding cover halves 50 which extend outwardly from the outlet. This configuration, prevents children from being able to stick their finger into the outlet itself. Also, because of the small opening on the outwardly extended portion of the round housing 40, the ability to stick an object into the outlet is reduced.

Figure 3:
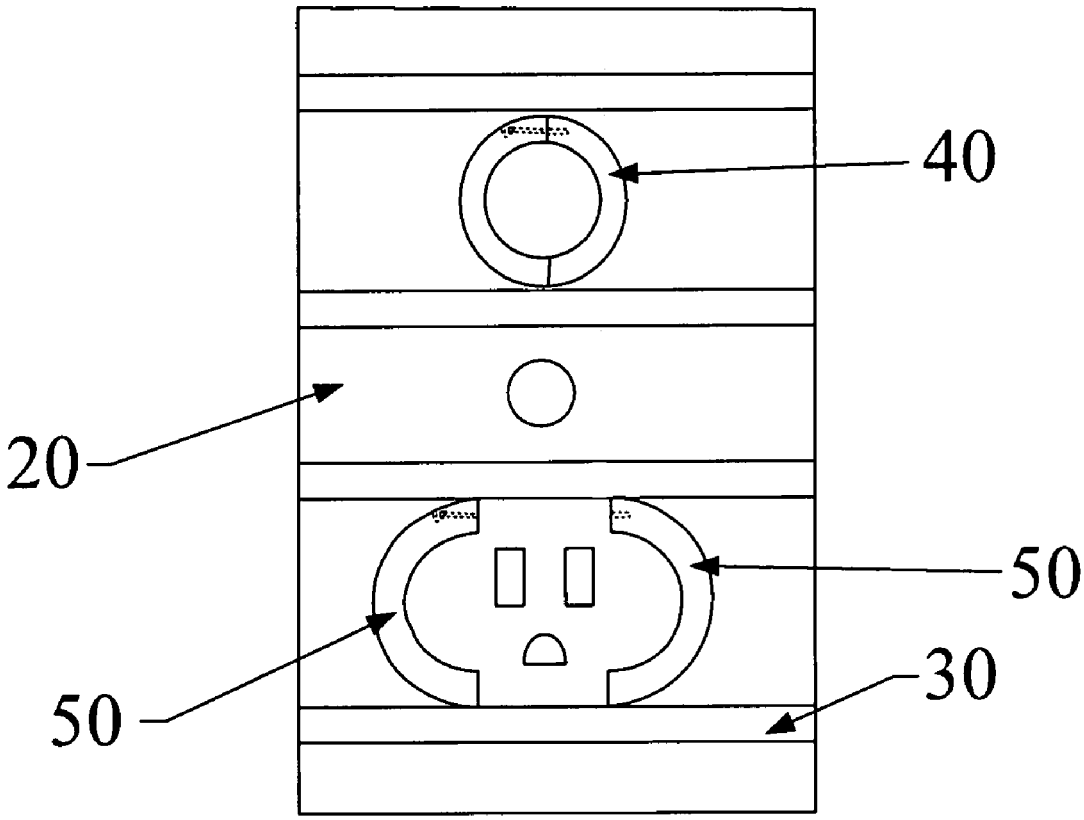
FIG. 3 is a front view of the locking outlet cover depicted in FIG. 1.

FIG. 3 is a front view of the locking outlet cover 10. The locking outlet cover 10 of FIG. 3 depicts the sliding cover halves 50 in a closed position and the sliding cover halves 50 in an open position.

Figure 4:
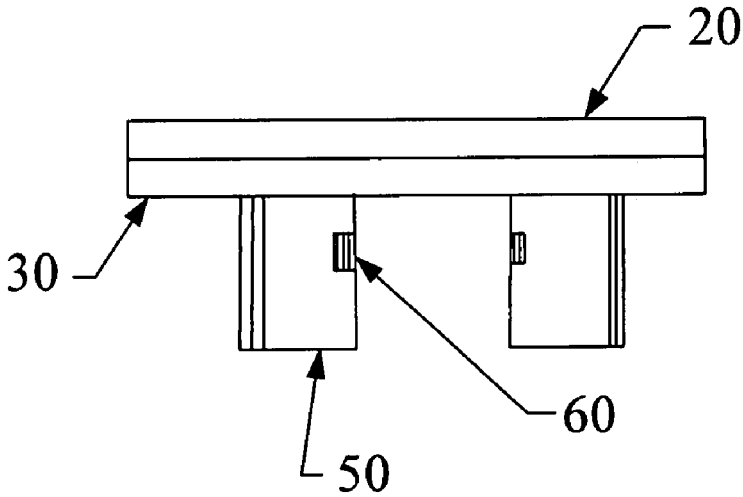
FIG. 4 is a top view of the locking outlet cover depicted in FIG. 1

FIG. 4 illustrates a top view of the locking outlet cover 10. Specifically, this view depicts the plate 20, the slide channels 30 and the threaded hole 60. The threaded hole 60 allows for the insertion of a screw to lock the sliding cover halves into place when in the closed position.

Although an embodiment of the present invention has been shown and described in detail herein, along with certain variants thereof, many other varied embodiments that incorporate the teachings of the invention may be easily constructed by those skilled in the art. Accordingly, the present invention is not intended to be limited to the specific form set forth herein, but on the contrary, it is intended to cover such alternatives, modifications, and equivalents, as can be reasonably included within the spirit and scope of the invention.

What is claimed:

1. A locking outlet cover comprising:

a plate that attaches to a regular electrical receptacle;

a slide channel located above and below each outlet opening;

a round housing operable to slide within said slide channels; wherein said round housing is divided into two sliding cover halves; and wherein said sliding cover halves extend outwardly; and a threaded hole located on each of said sliding cover halves of said round housing operable to insert a screw thereby attaching said halves of said round housing together.

2. The locking outlet cover of claim 1, wherein said round housing is operable to be locked into place when not in use.

3. The locking outlet cover of claim 1, wherein said sliding cover halves extend outwardly approximately one inch.

4. The locking outlet cover of claim 1, wherein said round housing is operable to close around an electrical cord plugged into the receptacle.

5. The locking outlet cover of claim 1, wherein said round housing is operable to be locked into place when an electrical cord is plugged into the receptacle.

6. The locking outlet cover of claim 1, wherein said locking outlet cover is comprised of thermoplastics.

7. The locking outlet cover of claim 1, wherein said locking outlet cover prevents removal of an electrical cord when in the locked position.

8. A locking outlet system comprising;

an electrical wall outlet;

a plate attached to said electrical wall outlet by way of a screw;

a slide channel located above and below each outlet opening;

a round housing operable to slide within said slide channels; wherein said round housing is divided into two sliding cover halves; and wherein said sliding cover halves extend outwardly; and a threaded hole located on said sliding cover halves of said round housing operable to insert a screw thereby attaching said halves of said round housing together.

9. The locking outlet system of claim 8, wherein said plate is comprised of thermoplastics.

10. The locking outlet system of claim 8, wherein said sliding cover halves extend outwardly approximately one inch.

11. The locking outlet system of claim 8, wherein said sliding cover halves are operable to lock around an electrical cord which is plugged into the socket.

12. The locking outlet system of claim 8, wherein said sliding cover halves are operable to be locked closed when not in use.

13. A method of using a protective electrical outlet containing a face plate attached to an electrical outlet, a slide channel located above and below each outlet opening, a round housing operable to slide within said slide channels and wherein said round housing is divided into two sliding cover halves, a threaded hole in each of said sliding cover halves; and a screw comprising the steps of:

unscrewing said screw from said sliding cover halves;

sliding said sliding cover halves apart;

inserting said electrical plug;

sliding said sliding cover halves together;

inserting said screw into said threaded hole;

screwing said sliding cover halves together.

* * * * *